US006112441A

United States Patent [19]

Offenhauer

[11] Patent Number: 6,112,441

[45] Date of Patent: Sep. 5, 2000

[54] GREETING AND INVITATION CARD

[76] Inventor: Sally S. Offenhauer, 629 17th Ave. West, Bradenton, Fla. 34205

[21] Appl. No.: 09/198,869

[22] Filed: Nov. 24, 1998

[51] Int. Cl.[7] ..... G09F 1/00

[52] U.S. Cl. ..... 40/124.191; 40/615; 40/675; 40/671

[58] Field of Search ..... 40/124.191, 671, 40/675, 615; 428/13; 283/117

[56] References Cited

U.S. PATENT DOCUMENTS

| | | | |
|---|---|---|---|
| 1,926,571 | 9/1933 | Weindel, Jr. | 40/124.191 X |
| 2,190,627 | 2/1940 | Payberg . | |
| 4,392,315 | 7/1983 | Irving et al. | 40/675 X |
| 4,579,754 | 4/1986 | Maurer et al. | 40/671 X |
| 5,117,569 | 6/1992 | Bean . | |
| 5,551,730 | 9/1996 | Barreca et al. | 40/124.191 X |

*Primary Examiner*—Terry Lee Melius
*Assistant Examiner*—William L. Miller
*Attorney, Agent, or Firm*—Charles J. Prescott

[57] ABSTRACT

A greeting and invitation card device having a substantially opaque paper-like rear sheet or panel and a translucent or transparent front or sheer overlay sheet or panel positioned against and in front of the rear sheet. The front sheet is imprinted to provide viewable greeting or invitation indicia. The rear sheet has a design formed of an array of apertures, preferably laser-cut, therethrough. The word indicia is readable simultaneous with viewing the design of the back sheet through the front sheet to provide a unique visual effect.

3 Claims, 4 Drawing Sheets

GREETING AND INVITATION CARD

BACKGROUND OF THE INVENTION

1. Scope of Invention

This invention relates generally to greeting and invitation cards, and more particularly to such a card formed of two panels, the front panel of which is translucent with printed greeting or invitational indicia thereon and the rear panel having an apertured design laser cut therethrough for simultaneous viewing of both indicia and design.

2. Prior Art

Laser and die cutting of greeting cards is well known in the industry and is well utilized to produce apertured paper and paper-like material of both natural and synthetic materials wherein the design is formed of an array of extremely finely cut apertures. The material is typically formed of opaque sheet material for use in conjunction with a greeting card.

Likewise, the use of transparent and translucent imprintable paper formed of both natural and synthetic materials are well known. Many greeting cards known to applicant include both transparent and translucent panels with printed word and/or design indicia thereon which is attached and positioned in front of an opaque rear panel which may also include printed design or word indicia formed thereon.

However, applicant is unaware of any prior art device which includes the combination of a front panel formed of imprintable translucent or transparent sheet material positioned in front of, and preferably of a similar size to, an opaque rear panel which has apertures formed therethrough by laser or die cutting or the like in an array defining a design. The design array of apertures is preferably formed by laser cutting to achieve a high level of delicacy and intricacy of the apertures. By this arrangement, the printed indicia is viewable from the front of the card while simultaneously being enhanced by the viewability of the design formed into the back panel and positioned directly behind the front panel as a sheet overlay.

BRIEF SUMMARY OF THE INVENTION

This invention is directed to a greeting and invitation card device having a substantially opaque paper-like rear sheet or panel and a translucent or transparent front or sheer overlay sheet or panel positioned and held against and in front of the rear sheet. The front sheet is imprinted to provide viewable greeting or invitation indicia. The rear sheet has a design formed of an array of apertures, preferably laser-cut, therethrough. The word indicia is readable simultaneous with viewing the design of the back sheet through the front sheet to provide a unique visual effect.

It is therefore an object of this invention to provide unique and highly marketable greeting and invitation cards which includes a front and a rear panel, the front panel being preferably translucent or transparent and capable of receiving printed indicia formed thereon, while the back panel is formed of preferably opaque material including, preferably, laser cut array of apertures forming a design therethrough.

It is yet another object of this invention to provide a greeting and invitation card device which includes a front panel formed of translucent or transparent material having printed indicia thereof and a rear panel formed of opaque material having an apertured design cut therethrough and wherein a variety of indicia and a variety of designs may be commercially offered to facilitate individuality in the make-up of each card.

It is still another object of this invention to provide a greeting and invitation card device which includes a front panel formed of translucent or transparent material having printed indicia thereof and a rear panel formed of opaque material having an apertured design cut therethrough and wherein a variety of indicia and a variety of designs may be commercially offered separately to facilitate individuality in card make-up and providing preferably a ribboned means for attaching the selected front and rear panels together to form the greeting card.

In accordance with these and other objects which will become apparent hereinafter, the instant invention will now be described with reference to the accompanying drawings.

DETAILED DESCRIPTION OF THE INVENTION

Figure 1:
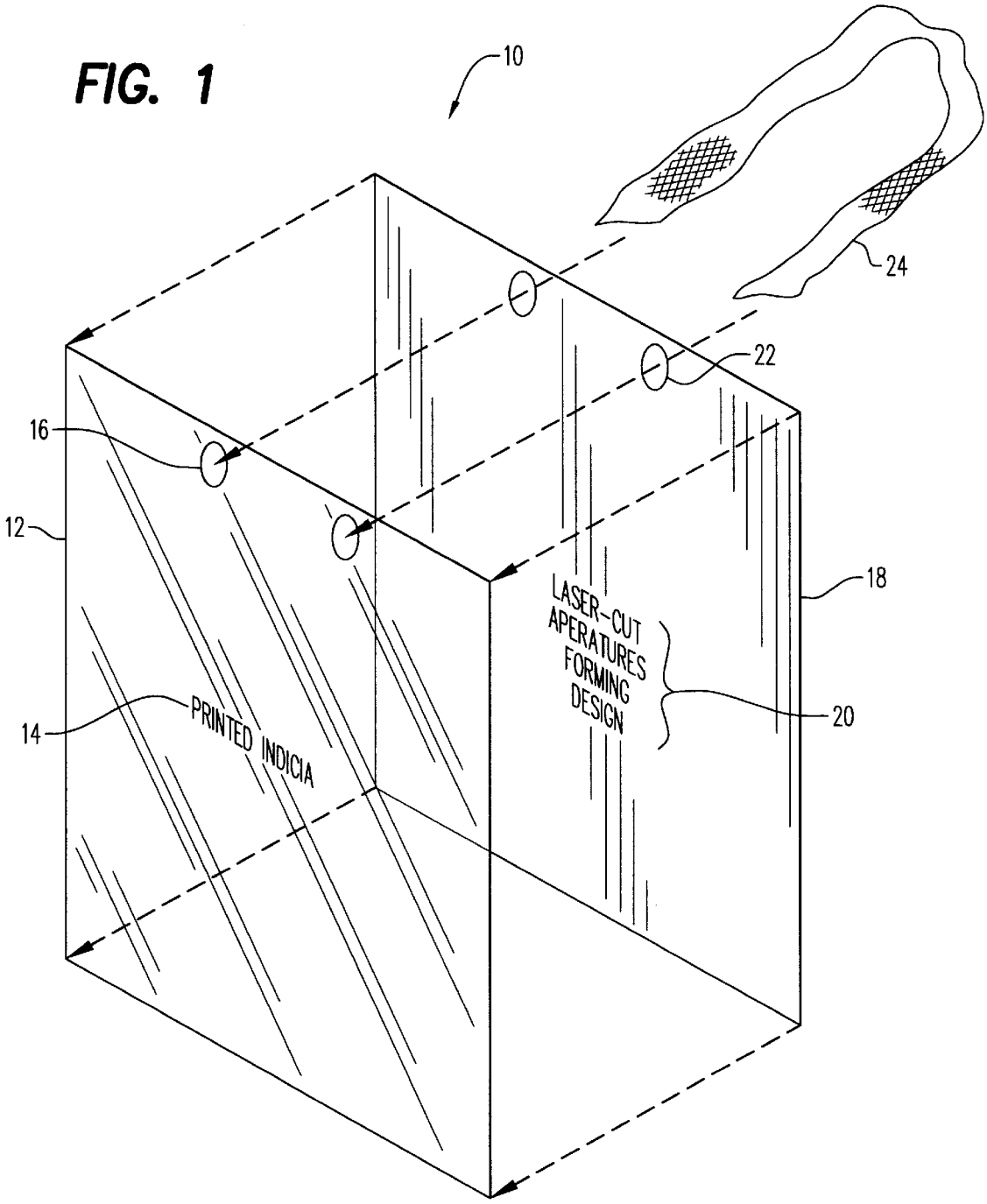
FIG. 1 is a perspective exploded view of the preferred embodiment of the invention.

Referring now to the drawings, the preferred embodiment of the invention is shown generally at numeral 10 and includes a front sheet or panel 12 formed of translucent or transparent material (preferably translucent) and a back sheet 18 of similar size and shape to that of the front sheet 12 which is formed preferably of opaque sheet paper material of either natural or synthetic materials.

Figure 2:
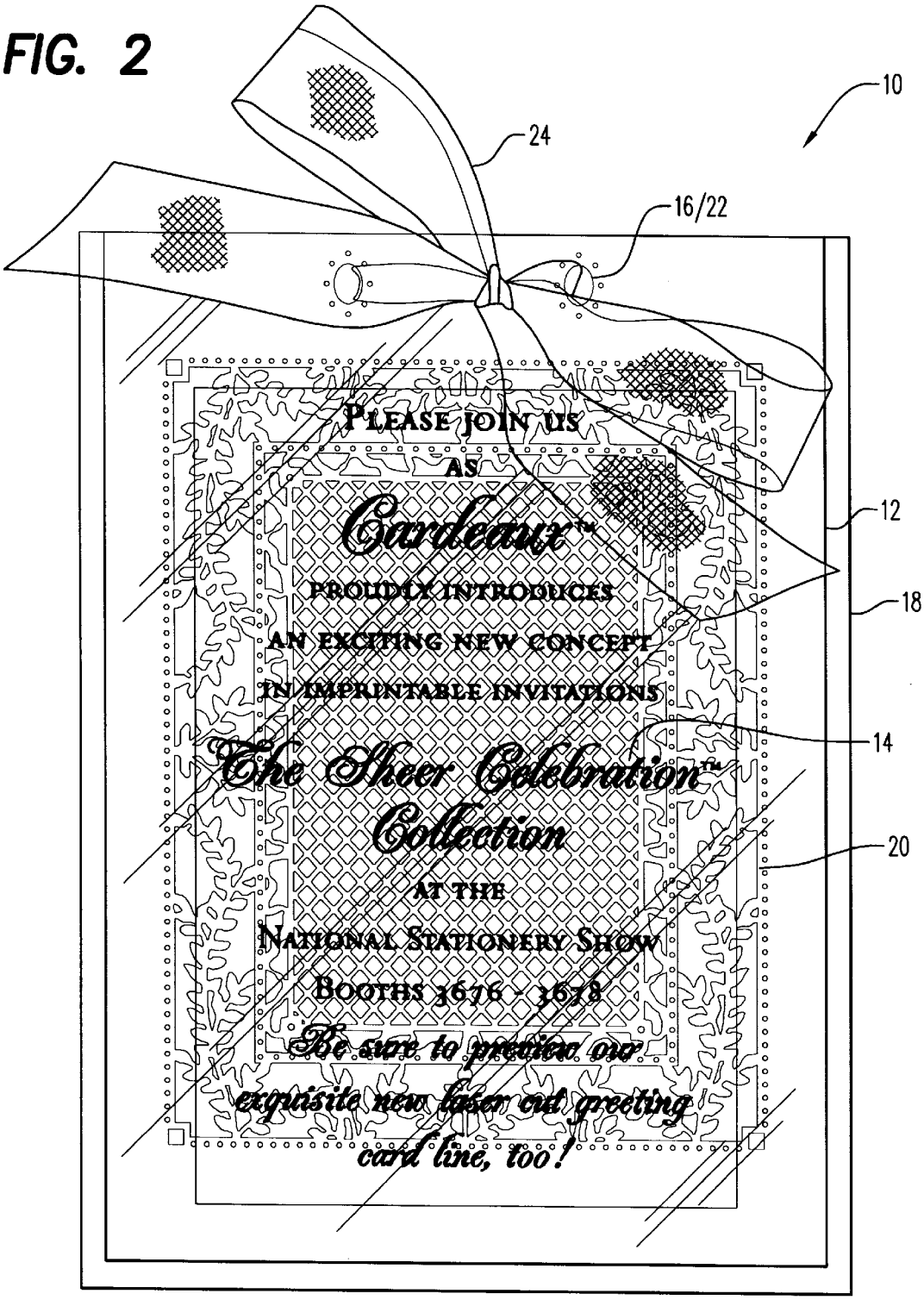
FIG. 2 is a front elevation view of the device of FIG. 1 in assembled form.
Figure 3:
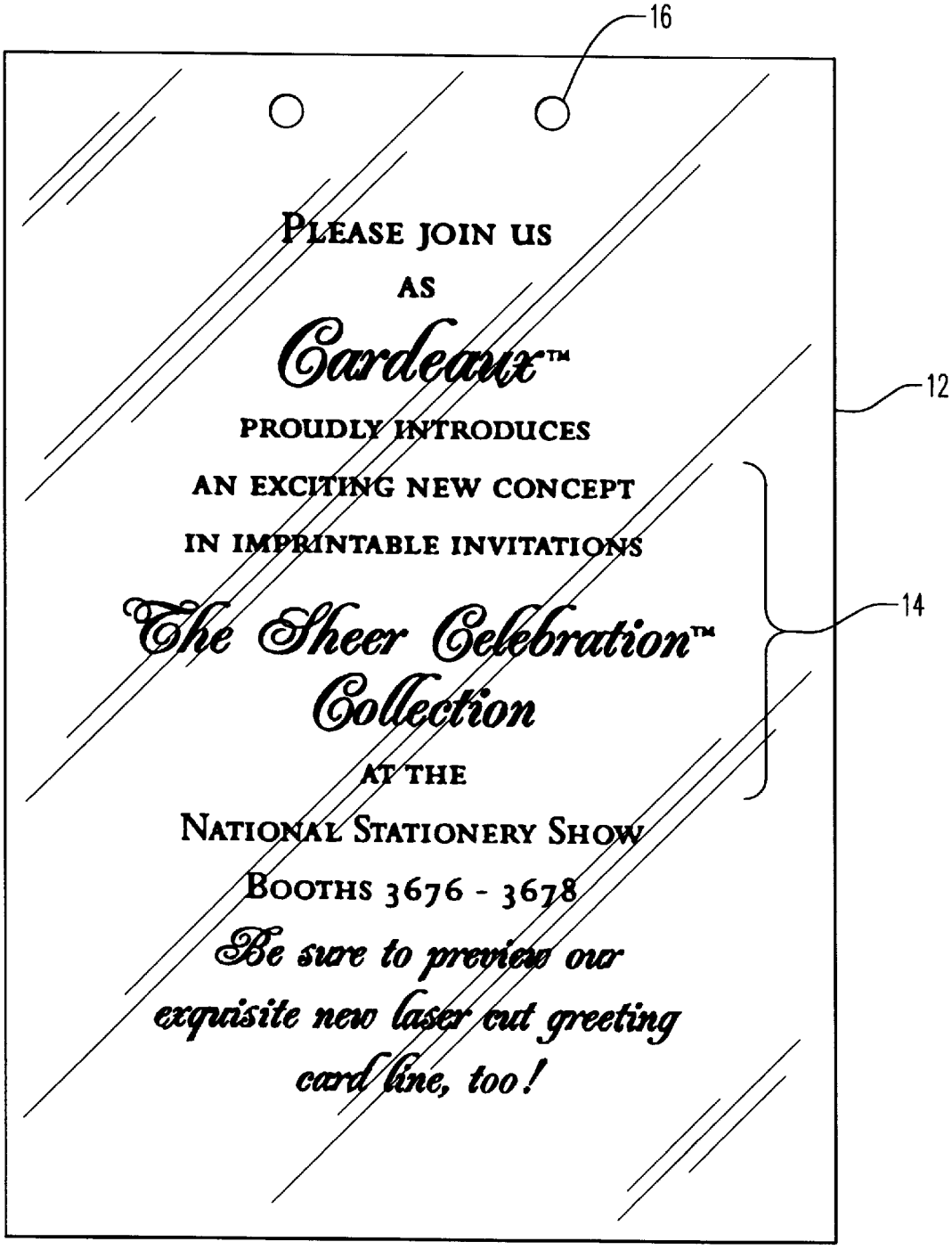
FIG. 3 is a front elevation view of the front sheet or panel of the greeting card device of FIG. 1.

The front sheet 12, as best seen in FIG. 2, also may be formed of synthetic or natural materials, sometimes referred to in the industry as a sheer overlay panel, the genetic term for such material being referred to as translucent printing paper. There are several manufacturers of such material including one referred to as the GLAMA Natural distributed by CTI Paper U.S.A., Inc. and manufactured by the PAPIERFABRIK SCHOELLERSHAMMER of Duren, Germany available in various paper weights and colors of translucency. A material thickness of 0.029" is preferred. The primary features of this material are that it be either translucent or transparent, and that it be imprintable with viewable written or ornamental indicia to form a greeting or invitational message.

Figure 4:
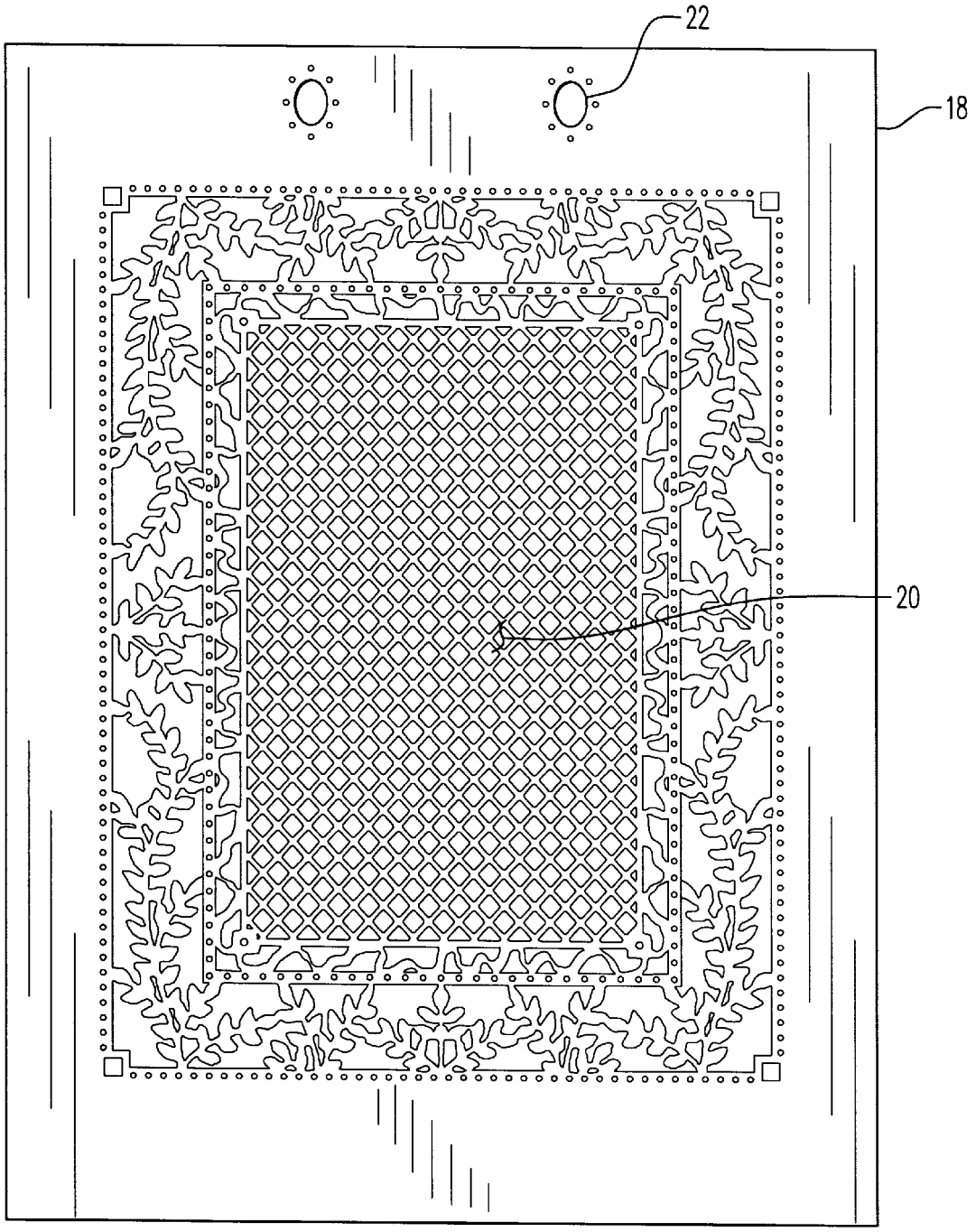
FIG. 4 is a front elevation view of a rear sheet or panel of the device of FIG. 1.

The rear sheet or panel 18, as best seen in FIG. 4, is formed of either natural or synthetic preferably opaque sheet material and preferably of a similar size and shape to that of the front panel 12, although artistic license to vary size and shape is within the intended scope of this invention. The rear sheet 18 includes an array of apertures 20, preferably formed by laser cutting, over a substantial area of the rear sheet 18. The delicacy and intricacy achievable by laser cutting of the design 20 is preferred.

The front sheet 12 and the rear sheet 18 both include connecting holes 16 and 22, respectively, which align with one another when these two sheets are placed against one another as shown by the arrows in FIG. 1. The preferred means for attaching the front and rear sheets 12 and 18, respectively is by a length of decorative sheer ribbon 24 which is passed forwardly through the mating holes 16 and 22 to form a bow as best seen in FIG. 2. However, all other known forms of attachment such as rivets, staples, adhesive and the like are envisioned by this invention.

As best seen in FIG. 2, the greeting or invitation card device 10 presents both a viewable word greeting or invitation indicia 14 printed onto the front panel 12 and as simultaneous viewing of the apertured design 20 formed into the back panel 18. This dual visual effect is facilitated primarily by the translucency or transparency as preferred, of the front sheet 12.

Obviously, any preselected printed greeting or invitational indicia 14 may be used, while any preselected apertured design 20 may also be selected both at the time of manufacture and at the time of consumer selection. That is to say, the greeting card 10 may be marketed as a ready-to-send greeting card with both front and rear panels 12 and 18 attached to one another as by a ribbon 24, or separately with each of these front and back sheets 12 and 18, respectively, individually selected and then attached together to suit each customer's taste and needs.

Form of Attachment

The preferred embodiment of the means for attaching the front and rear sheets 12 and 18, respectively, together is as above described in the form of a length of sheer delicate ribbon 24 which is passed through mating apertures 16 and 22 and then tied together to form an attractive bow as shown in FIG. 2. The use of ribbon connection facilitates a retail mix and match versatility wherein the purchaser may fasten the chosen front and rear sheets together at or after purchase. However, other means of attachment are envisioned within the scope of this invention including adhesion, decorative rivet, overlapping edges of either the front or rear panel 12 or 18, respectively, to encapsulate the edges of the other sheet 18 or 12, respectively. Further, the front translucent or transparent panel may also include an integral rear panel with a central transverse fold line so as to lay against both the front and the back surfaces of the rear sheet 18.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An invitation card comprising:

a front sheet formed of imprintable transparent or translucent material and having printed indicia on one surface thereof;

a rear sheet separate from said front sheet formed of generally opaque material and having an array of small apertures formed therethrough over a substantial portion of said rear sheet which collectively define a design;

said front sheet, when positioned against and generally in alignment and registry with said rear sheet, providing sufficient translucency for viewing said design through said front sheet while simultaneously viewing said printed indicia;

a length of ribbon or string attachable through an alignment aperture formed through each of said front and rear sheets.

2. A mix and match greeting and invitation card system comprising:

a plurality of separate front sheets each formed of translucent printable material adapted to receive a different imprinted worded greeting or invitation indicia on one surface thereof;

a plurality of separate rear sheets each of similar size and shape to that of each said front sheet, each said rear sheet formed of substantially opaque material and having an array of apertures forming a design over a substantial area of said rear sheet;

whereby any combination of a selected said front sheet positioned in front of and against a selected said rear sheet provides viewability of said design through the selected said front sheet;

a length of ribbon or string attachable through an alignment aperture formed through each of said front and rear sheets.

3. A greeting and invitation card device comprising:

a paper-like design sheet having an array of apertures formed therethrough defining a design;

a sheer overlay sheet separate from said design sheet and formed of translucent or transparent natural or synthetic material with imprinted greeting or invitation indicia on one surface thereof;

a length of ribbon or string attachable through an alignment aperture formed through each of said design and overlay sheets for attaching said overlay sheet against and in frontal alignment with said design sheet, said design being viewable through said overlay sheet with said indicia appearing in front of said design.

* * * * *